US006715234B1

(12) United States Patent
Libardi

(10) Patent No.: US 6,715,234 B1
(45) Date of Patent: Apr. 6, 2004

(54) TURNSTILE ENTRY GATES

(75) Inventor: Mario Libardi, Levico Terme (IT)

(73) Assignee: Gunnebo Entrance Control AB (SE)

( * ) Notice: Subject to any disclaimer, the term of this patent is extended or adjusted under 35 U.S.C. 154(b) by 81 days.

(21) Appl. No.: 09/980,308

(22) PCT Filed: May 29, 2000

(86) PCT No.: PCT/SE00/01106

§ 371 (c)(1),
(2), (4) Date: Feb. 15, 2002

(87) PCT Pub. No.: WO00/77338

PCT Pub. Date: Dec. 21, 2000

(30) Foreign Application Priority Data

May 28, 1999 (SE) ..... 9901957
Jul. 5, 1999 (SE) ..... 9902572

(51) Int. Cl.[7] ..... E05D 15/02; E06B 11/08
(52) U.S. Cl. ..... 49/42; 49/43; 49/46
(58) Field of Search ..... 49/42, 46, 43, 49/47; 105/341.5; 235/93

(56) References Cited

U.S. PATENT DOCUMENTS 3,445,962 A * 5/1969 Byland et al. ..... 49/46
3,559,341 A 2/1971 Alvrado
3,913,717 A * 10/1975 Collins ..... 49/46 X
3,914,902 A * 10/1975 Lamberson ..... 49/47
3,998,008 A * 12/1976 Collins ..... 49/47
5,072,543 A * 12/1991 Tetherton ..... 49/47
5,471,795 A 12/1995 Gallenschutz et al.
5,605,015 A * 2/1997 Uhl et al. ..... 49/47
6,065,246 A * 5/2000 Detassis ..... 49/47

FOREIGN PATENT DOCUMENTS

SE 505679 9/1997
WO 9008875 8/1990

OTHER PUBLICATIONS

International Search Report dated Aug. 16, 2000 for Application No. PCT/SE00/01106.

* cited by examiner

*Primary Examiner*—Hugh B. Thompson, II
(74) *Attorney, Agent, or Firm*—Ostrolenk, Faber, Gerb & Soffen, LLP

(57) ABSTRACT

A turnstile entry gate comprising at least two, at equiangular distances on an arm carrier (5) mounted barrier arms (2–3), the arm carrier (5) being by way of a remote-controlled barrier device (6) arranged to permit or to prevent turning in at least one rotational direction. The arm carrier (5), or at least one of disks (7; 8) arranged near and connected thereto exhibits a magnetic strip (9) preferably extending circumferentially and adapted, by way of sensors, to indicate the position and the direction of movement of the turnstile. The barrier function of the device (6) is normally mechanically disconnected when one of the barrier arms (2–4) in the turnstile is in its home position, i.e. horizontally oriented, the sensor and electronic systems only checking that a passage has taken place and that, with the aid of e.g. a spring and/or hydraulics, the turnstile can assume its next home position.

10 Claims, 5 Drawing Sheets

TURNSTILE ENTRY GATES

The present invention relates to a turnstile entry gate comprising at least two at equiangular distances spaced barrier arms on a rotatable arm carrier which by means of a remote control barrier device can be prevented or permitted, respectively, to turn in at least one turning direction. Adjacent the arm carrier there is also a control disk with a track formation extending around its periferi with recesses between triangular cam means, spring-biased positioning means can be derolled in said track formation and against said cam means in order always to keep one of the barrier arms oriented in its home position, i.e. in a horisontal locking position.

Turnstiles of the type mentioned are today normally in a closed stage meaning that a solenoid holds the mechanism for a turnstile in the home position of the barrier arms. When an admission signal appears in the passage system the solenoid is disconnected so that there can occur a rotation clockwise or counterclockwise in respons to the type of control signal coming from the electronic equipment.

A disadvantage of this type of normally closed passage system, having for example a solenoid locked mechanism of this kind is inter alia that the solenoid used does always require a feed current.

The object of the present invention is to provide a turnstile for entrance barriers the locking function of which is normally disconnected meaning that the locking of the barrier arms of the turnstile when in the home position is mechanically released also in the absence of an admittance of a accepted signal (stand by). When signal is accepted or approved, only a sensor system and the electronic equipment will check that the passage has taken place and that the turnstile, with the aid of for example a spring and/or hydraulics, will assume the next home position. The characterizing features of the invention are set out in the claims enclosed.

Thanks to the invention there is now provided a turnstile which in an excellent way satisfies its purpose at the same time having low manufacturing costs. The sensor system according to the invention is constituted by a magnet strip which is read by at least one sensor and preferably in the shape of an adhesive tape is attached to for example, a home position disk. The mechanism is provided with a rubber damping unit which provides a soft breaking or dumping of the turnstile when its barrier arms are in there home positions. Thanks to this sensor system there is achieved an indication confirming that the rotation of the turnstile occurs in the intended direction. The system does also give the electronic equipment a response confirming that the person concerned has passed. When the home position has been reached after a passage confirmation, this solenoid used for the normally closed position will return to its released state.

If an effort to make an unpermitted passage is tried, the positioning system will to the electronic equipment supply an early indication which does in turn activate the solenoid concerned for the purpose of locking the turnstile via a control disc in the unpermitted direction but permitting return to the initial position. Thanks to the fact that the mechanical locking function for the turnstile is disconnected in the home positions of the turnstile the current consumption is lower than when, in the normal way, the solenoids are kept activated, as is the case in prior art turnstile installations. In addition to the reduced current consumption there is acheived a significant increase of the useful life of the product according to the present invention.

If desired, the barrier arms of the turnstile can be tiltable when in their home positions, so that, e.g. at a fire alarm, the locking arm is released to fall down from its horisontal position to a vertical evacuation position. In this type of design a solenoid is activated, e.g. in repsons to fire alarm or an evacuation alarm and influences, via a spring-biased activation arm, a pin, mounted in the lockbridge of the arm mechanism which is in turn normally is held in position by a spring force. This results in the arm becoming released and falling from its horisontal position to a vertical evacuation position. When resetting shall take place, the arm is manually brought to its horizontal position were fixation accurs automatically. This offers a simple and cheep solution in contrast to what is the case according to the prior art.

A preferred embodiment of the invention will now be described with reference to the accompaning drawings.

Figure 1:
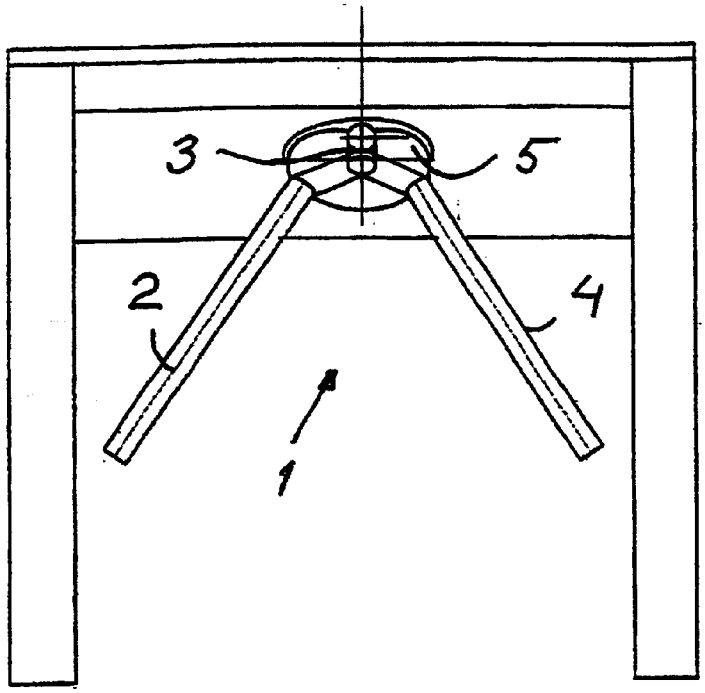
FIG. 1 is a diagrammatic, perspective view of a turnstile entry gate according to the invention.
Figure 2:
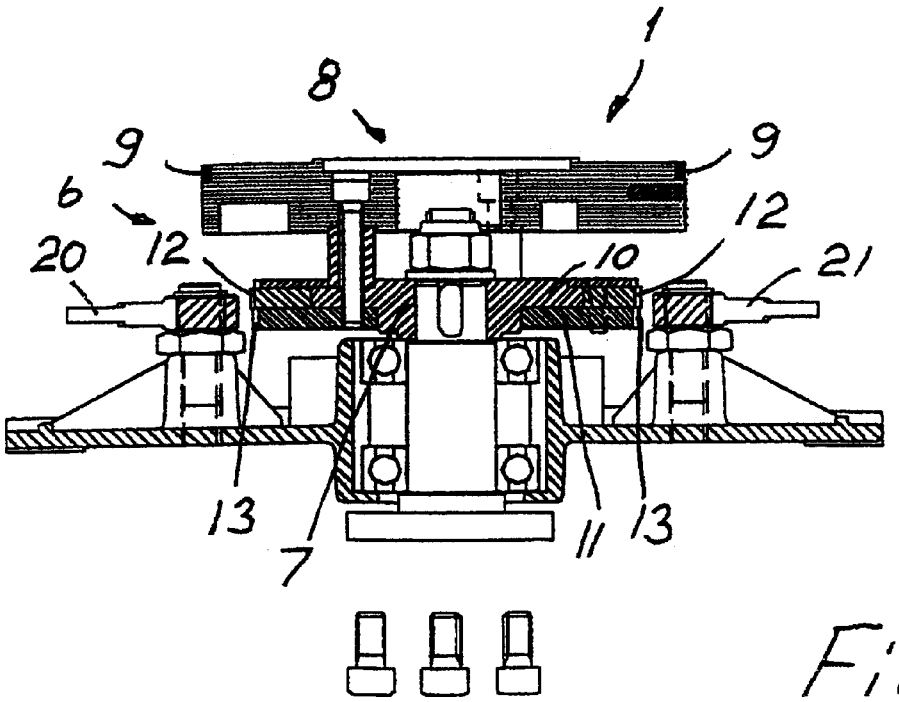
FIG. 2 is a partially diagrammatic lateral cross-section view showing a turnstile mechanism for the turnstile illustrated in FIG. 1.
Figure 3:
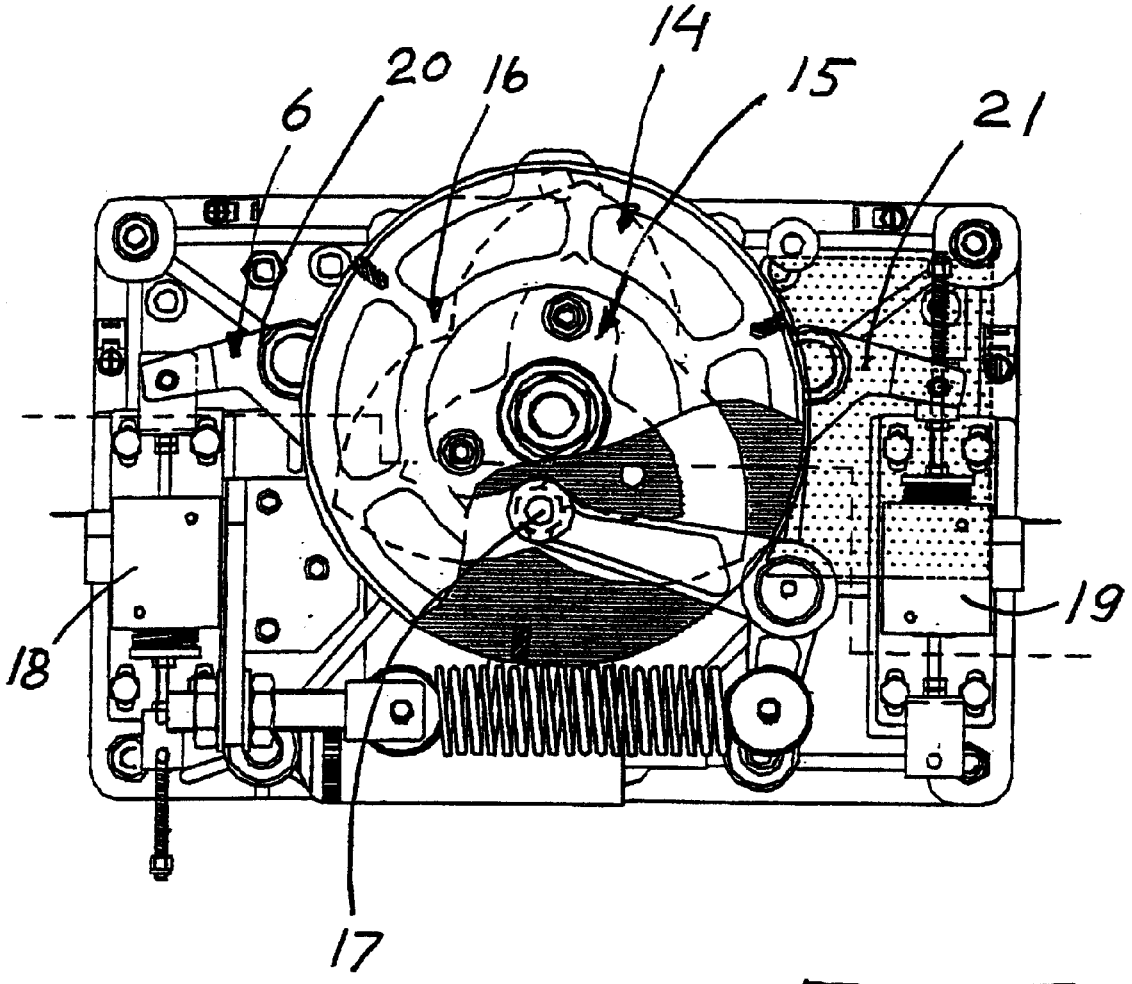
FIG. 3 is a diagrammatic partially cross-section horizontal view of the turnstile mechanism according to FIG. 2.
Figure 4:
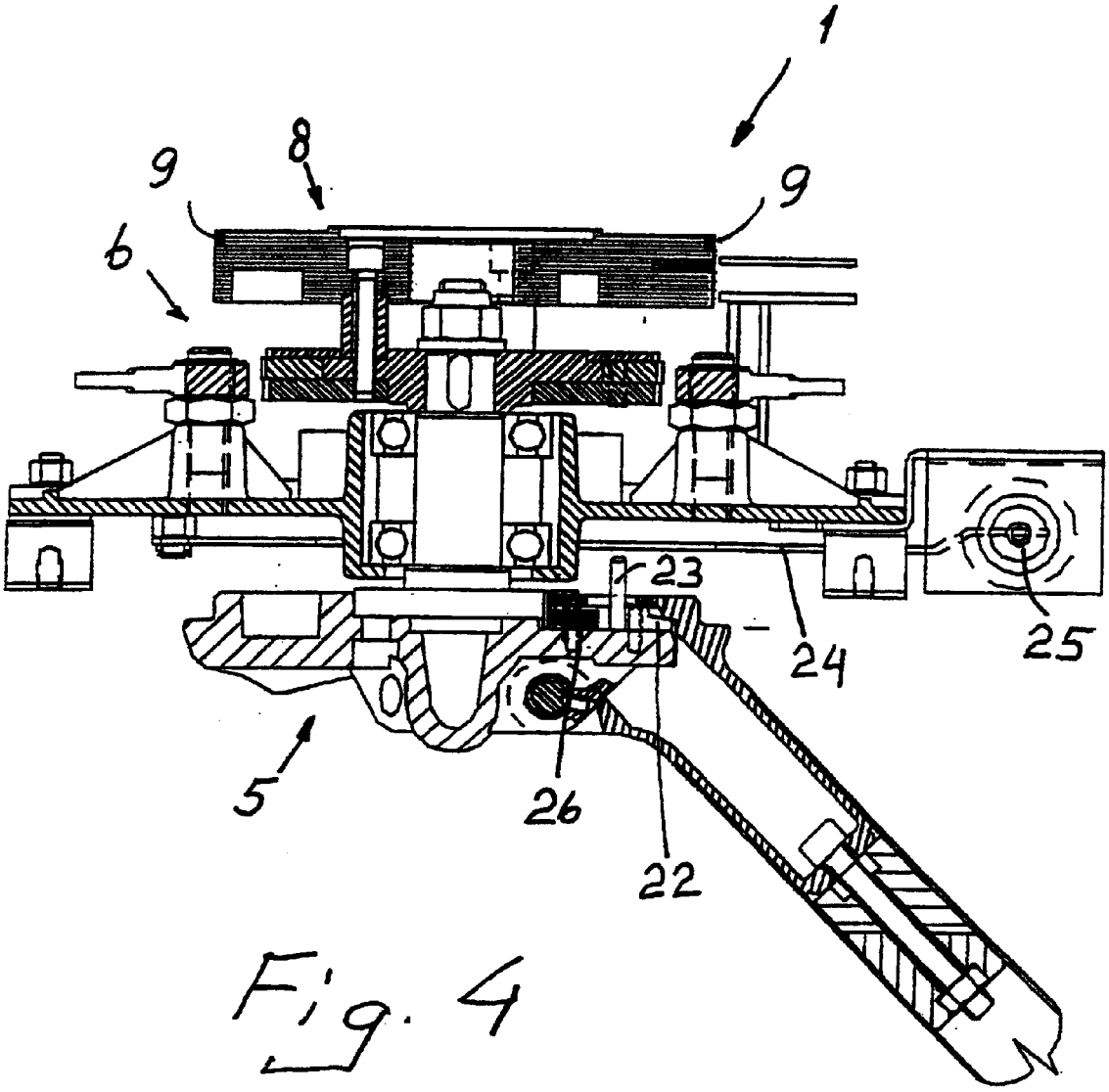
FIG. 4 is a side view in cross-section of the turnstile mechanism comprising a turnstile with tiltable barrier arms.
Figure 5:
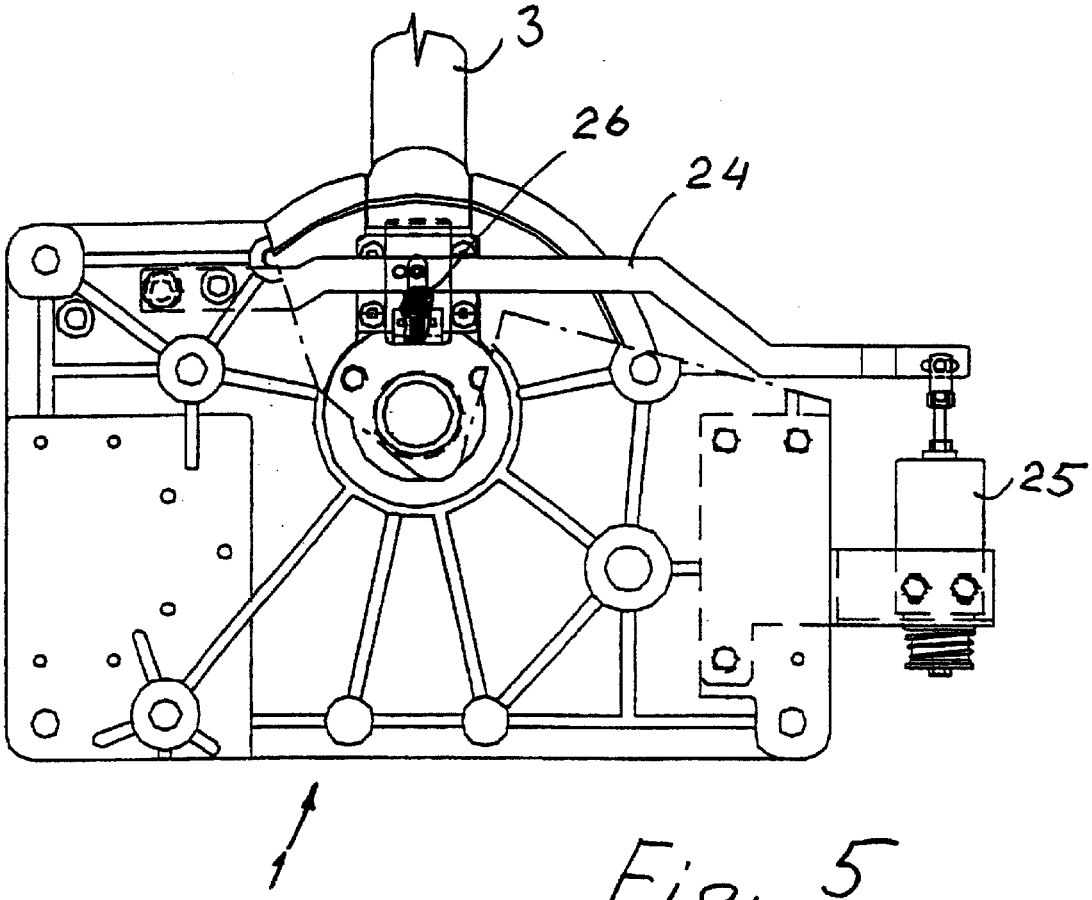
FIG. 5 is a horizontal view showing the turnstile mechanism of FIG. 4.
Figure 6:
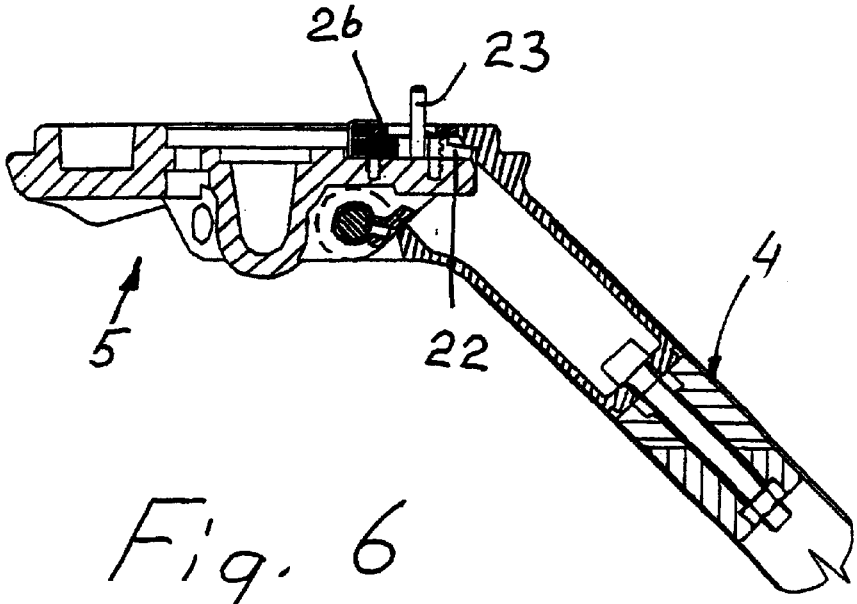
FIG. 6 is a partial side view in cross-section showing the arm carrier and its barrier arms.
Figure 7:
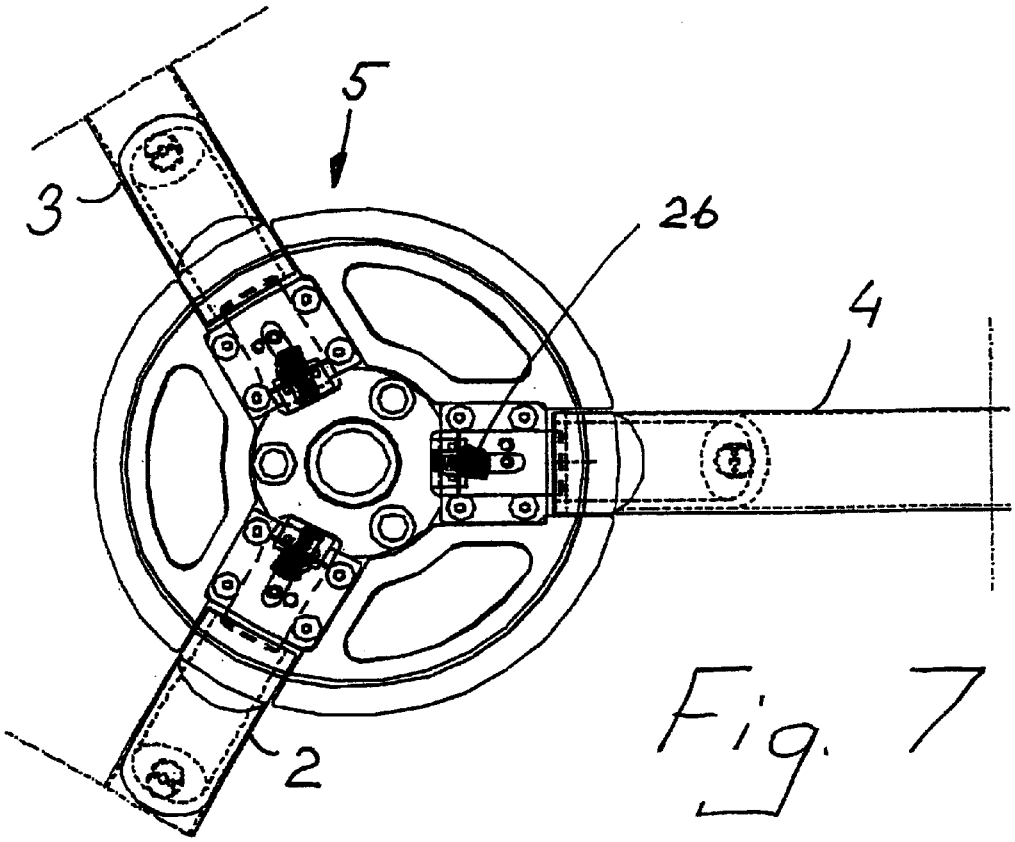
FIG. 7 is a horizontal view showing the device in FIG. 6.

According to a preferred embodiment of the present invention the turnstile 1 comprises three, at an equal angular distances arranged barrier arms 1, 3, 4. The barrier arms 2–4 are mounted on a rotable arm carrier 5 which by means of a remote control barrier device 6 can be locked to prevent or to permit, respectively, turning in at least one rotationally direction with the aid of a control disk 7 situated above the arm carrier 5. Above the control disk 7 there is a home position 8 at the circumferentially of which there is secured a magnetic tape 9, for example in the form of an adhesiv tape. This magnetic strip 9 is arranged to be scanned by aid of sensors not shown in the drawing, which can detect both the position and the direction of movement of the turnstile 1.

The control disk 7 consists of three parts, namely a core 10 made of metal, a locking disk 11 mounted below the core 10 and also consisting of a metallic material, and outer, circumferentially situated theeth 12 of a suitable flexible material, preferably rubber. The function of these teeth 12 is to observe the first portion of the kinetic of the turnstile 1 before it has brought to a complete stop by metallic teeth 13 on the locking disk 11.

The home position of the turnstile 1 are defined by a recess formation 14 with cam means 15 in connection to or formed in the control disk 7 having a number of recesses 16 corresponding to the number of barrier arms 2–4. In the example chosen there are shown three triangular cam means 15 and, consenquently, three recesses 16, since the number of a barrier arms is three. A spring-biased positioning member 17 is derolled in contact with the cam means 15. The lock or barrier function of the control disk 7 by means of the barrier device 6 is carried out by rocker arms 20, 21 activated upon by solenoids 18, 19 and cooperated with the teeth 12, 13 at the circumference of the disk 7. In addition to the spring-biased positioning members 17 for the fixation in there home positions of the barrier arms 2–4 of the turnstile 1 hydraulic equipment can be used and the so-called home positions are reached when one of the barrier arms has assumed its horisontal orientation as mentioned above.

According to the preferred example the locking function of the device 16 is mechanically disconnected in a home position for any of the barrier arms 2–4 of the turnstile, also without an unaccepted signal, meaning that the turnstile is normally opened and that, upon acceptance or approval of a signal only the sensor system and the electronic system will check that the passage takes place and that the turnstile, by aid of the positioning member 17 assumes its next home position. The positioning system supplies a clear indication to the electronic system when efforts for unpermitted passage occurs, the solenoid concerned then being activated by the electronic system in order to prevent movement in the unpermitted direction but permit return to the initial position.

When desired the barrier arms 2–4 of the turnstile 1 can be tiltable as well. In that case each barrier arm is mounted in the arm carrier 5 and held in position there via a locking pin 23 in a locking bridge 22 for the barrier arms 2–4. The locking pin 23 can, for example at power failure or evacuation, be actuated by a spring-biased actuation arm 24, causing release of the arm concerned so that it falls from its horisontal position to an evacuation position. Accordingly, the solenoid 25 concerned is actuated by the electronic system, the spring load in the system resulting in that the actuation arm 24 is turning around its mounting point and then acts against the pin 23, mounted in the lock bridge 22 of the arm mechanism. The lock brigde 22 in turn is normally held in position by means of a recilent force, supplied by IJA spring member 26 in the shape of a spring or a piece of rubber.

When resetting shall take place the solenoid 25 is automatically activated when the current returns or when the evacuation alarm is deactivated. The barrier arms 2–4 are then manually returned to their horisontal position where automatic locking takes place.

What is claimed is:

1. A turnstile entry gate assembly comprising:

a gate;

a rotatable arm carrier which is rotatable in at least one turning direction;

a remote-controlled barrier device operable to selectively permit and prevent the turning of the rotatable arm carrier;

barrier arms on the rotatable arm carrier projecting from the carrier and rotatable the carrier and defining barrier arms for the gate; each of the arms being rotatable by the rotatable arm carrier to a home position and away from the home position; magnetic tape coupled with the rotatable arm carrier to rotate therewith;

sensors on the gate assembly for sensing the position of the magnetic tape for providing an indication of the position and the direction of rotation of the movement of the rotatable arm carrier, and the gate sensors being operable to determine that a passage past the gate assembly has taken place and that the assembly including the arm carrier and barrier arm has operated so that one of the arms is in a home position;

the remote-controlled barrier device being so connected with the sensors and being operable so that a bar function of the barrier device is normally mechanically disconnected when one of the barrier arms is in the home position.

2. The turnstile entry gate assembly of claim 1, wherein there are at least two of the barrier arms.

3. The turnstile entry gate assembly of claim 2, wherein the barrier arms are equally angularly spaced apart on the carrier.

4. The turnstile entry gate assembly of claim 2, further comprising each barrier arm being pivotably mounted in the rotatable arm carrier and a respective releasable lockpin holding each barrier arm in non-rotatable position to the arm carrier;

a spring-biased actuation connected with the pin and operable such that upon occurrence a power failure, the spring-biased actuation causes the respective pin to operate to cause each barrier arm to be released thereby enabling each barrier arm to pivot and fall from a horizontal position to an evacuation position.

5. The turnstile entry gate assembly of claim 1, wherein the home position of one of the barrier arms is horizontally oriented.

6. The turnstile entry gate assembly of claim 1, further comprising a spring or hydraulic device for actuating the gate assembly for rotating the rotatable arm carrier so that one of the barrier arms assumes the home position.

7. The turnstile entry gate assembly of claim 1, further comprising rotatable disks adjacent the arm carrier, and the magnetic tape is on the disks.

8. The turnstile entry gate assembly of claim 7, wherein the magnetic tape is wrapped circumfentally around the disks.

9. The turnstile entry gate assembly of claim 8, further comprising a home position disk located above the rotatable arm carrier and supporting the magnetic tape, and a control disk between the arm carrier and the home position disk;

the barrier device being comprised of the control disk and of rocker arm, solenoids connected with the rocker arms so that the rocker arms are actuated opened by the solenoids to fore the barrier device.

10. The turnstile entry gate assembly of claim 9, wherein the control disk has circumferential teeth including flexible teeth for damping the return of one of the barrier arms to the home position and additionally including metal teeth for locking the gate and the rotatable arm carrier.

* * * * *